United States Patent [19]

Jeney

[11] 4,281,705

[45] Aug. 4, 1981

[54] PROCESS FOR CASTING OBJECTS HAVING COMPLICATED SHAPES

[75] Inventor: Tibor Jeney, Budapest, Hungary

[73] Assignee: NOVEX Tálalmányfejlesztö és Értékesitö Külker. Rt., Budapest, Hungary

[21] Appl. No.: 15,319

[22] Filed: Feb. 26, 1979

[30] Foreign Application Priority Data

Mar. 14, 1978 [HU] Hungary ..... 831

[51] Int. Cl.[3] ..... B22D 19/00; B22C 9/04

[52] U.S. Cl. ..... 164/10; 164/34; 164/246

[58] Field of Search ..... 164/34, 9, 10, 45, 246

[56] References Cited

U.S. PATENT DOCUMENTS

| | | | |
|---|---|---|---|
| 3,498,360 | 3/1970 | Wittmoser et al. | 164/34 X |
| 3,572,421 | 3/1971 | Mezey et al. | 164/34 X |
| 4,010,791 | 3/1977 | Hetke et al. | 164/34 |

FOREIGN PATENT DOCUMENTS

| | | | |
|---|---|---|---|
| 850331 | 10/1960 | United Kingdom | 164/34 |
| 431957 | 11/1974 | U.S.S.R. | 164/34 |

*Primary Examiner*—R. L. Spruill
*Assistant Examiner*—J. Reed Batten, Jr.

[57] ABSTRACT

A method for casting objects having complicated shapes from aluminum, zinc, non-ferrous metals and the like, for use in the industrial arts, comprises the steps of using a completely combustible and gasifiable foam material to constitute a form in which the objects are cast, removing a thin surface layer of the foam from those surface areas where a wall thereof could be damaged by flowing melted metal, where ornamental elements or profiles are to included in the objects prior to casting, or where the rate of flow of melted metal is to be decreased, substituting the removed foam layer by a protective layer of a material with a stronger structure, lower thermal conductivity, lower burning and gasifying rates than those of the material of the foam casting form, reconnecting the separated foam and protective layers by gluing, embedding the casting form into sand, pouring melted metal into a recess defined by the foam form while in the sand and delaying and regulating the burning of the foam during the pouring of the metal as well as the gasification of the foam.

8 Claims, 2 Drawing Figures

PROCESS FOR CASTING OBJECTS HAVING COMPLICATED SHAPES

Figure 1:
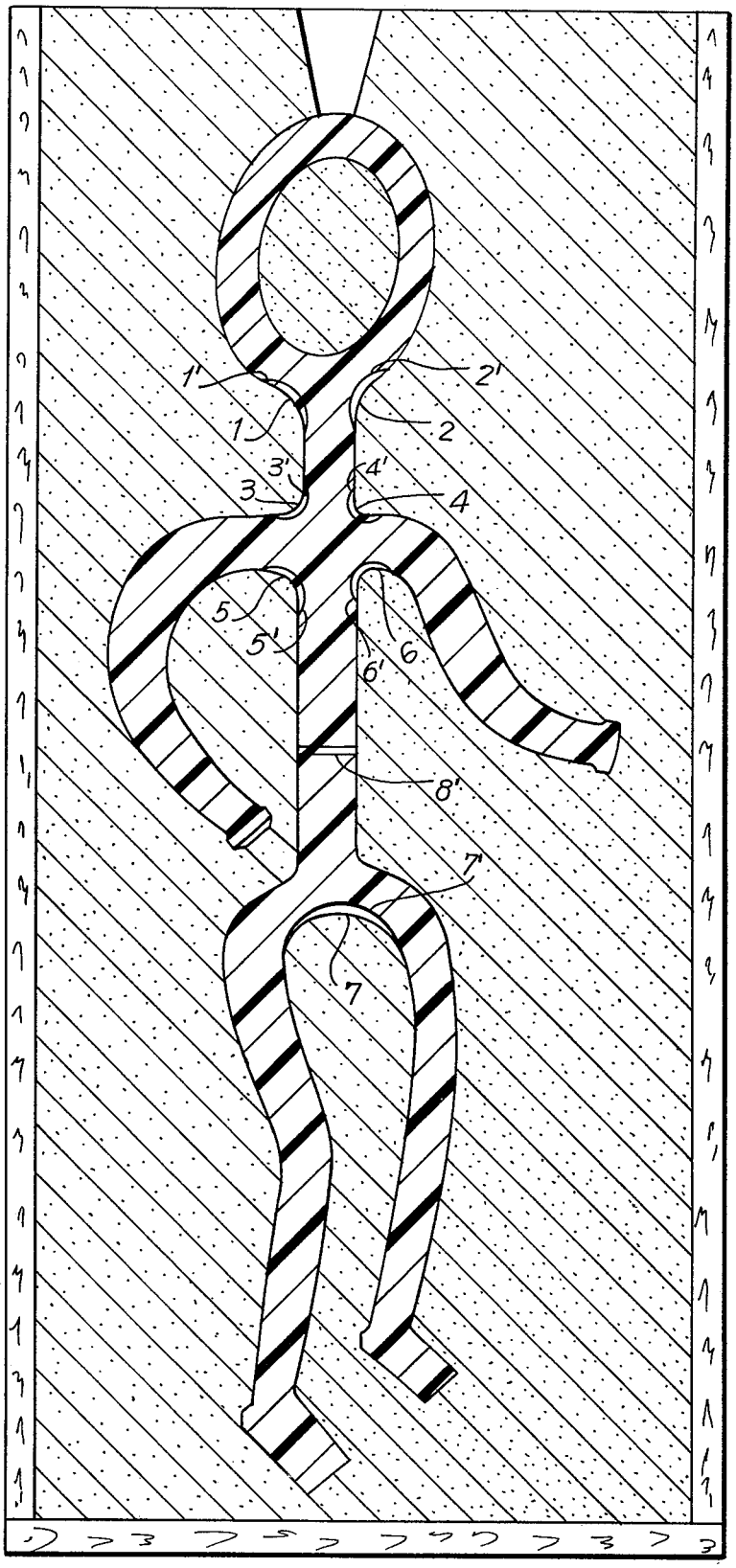

This invention relates to a process for making objects with complicated shapes, e.g., from aluminum, zinc, non-ferrous metals, etc. by means of casting. By applying this process small series of objects of the industrial arts can be produced, possibly provided on their surfaces with different ornaments and elements of different materials and having different shapes, according to the design of the artist and with a proper quality.

It is a frequent task in the industry and in the industrial art to produce objects with complicated shapes by way of casting. The casting of such complicated objects is a serious problem for the technology becasue on account of the complicated shapes and artistic designs of these objects, the necessary casting forms cannot be produced in the traditional manner. The complicated shape makes it sometimes impossible to use the traditional mold box or flask since the core and the foundry model cannot be separated in such a way that two or threee flasks could be formed in the sand. Upon separation of the flasks, the foundry model cannot be removed from the sand without injuring the forming recess in the sand.

When casting objects of this type it is not recommended to apply die-casting tools because these objects can be made only in small series while the preparation of such tools is expensive and complicated.

It is a frequent task—mainly in the case of objects for the industrial arts—to provide on the surface of an object cast from some given material, ornamental elements made from some other material. These elements are usually mounted later either by different mechanical bonding procedures and/or by gluing. Mechanical bonding requires special preparation of the surface. For example, if ears or the like are to be added to the object, this complicates the casting process even more. Ears and similar forms break off easily, and as a consequence the ornamental element drops from the object. Neither is proper fixing achieved by using a glue in such cases.

Efforts have been made to solve the problem of fixing of different ornamental elements by embedding them into the forming sand and casting them around with the metal of the object. This method, however, can only be applied with objects for industrial purposes where the element or profile has a material with a significantly higher melting temperature than that of the material of the object iself. This method cannot be applied for objects for the industrial arts because in these cases the ornamental elements consist usually of glass or semi-precious stones. When these are being kept for a ling time at the melting temperature of the metal of the objects, they are injured or completely destroyed.

When preparing objects for the industrial arts, it is a frequent task to apply ornaments at different surface points made of pulverized stone of a different color and in different shapes. Such elements cannot be fixed by gluing, because their shape does not permit it. They cannot be fixed either into the surface of the casting recess in the sand because the metal that flows in a liquid state would sweep them away. The object itself cannot be made either so that some kind of mechanical bonding is applied.

The casting of objects with relatively small diameters, complicated shapes and branches often means serious problems, namely the melted metal flows through the small cross sections and becomes solid prior to filling completely the entire casting recess. In numerous cases—maily when casting objects for the industrial arts—the technology usually applied for the casting of simple industrial objects cannot be used since artistic and aesthetic aspects are also to be considered. On the surface of an artistic object there cannot be traces of some removed rising, pad or boss.

Another solution casting objects with complicated shapes is, where the form corresponding to the shape of the object to be cast is made of combustible foamy synthetic material, e.g. polystyrene or polyethylene. This synthetic form is embedded into the sand, the melted metal is poured over it, and this burns and gasifies the foamy material. This foamy form keeps the wall of the form-recess strong enough so that upon the solidification of the metal the object results with a proper shape.

This solution, however, has a disadvantageous property, namely, when the foamy casting form gets into contact with the melting metal, it burns too quickly. There is no more material besides the walls of the form recess when the melted metal still streams at a high rate, so on account of the erosive effect the wall of the recess is easily abraded and damaged. When there is some ornamental or any other decorative element made of a different material, it is swept away. When the ornament is made of a material the melting temperature of which is lower than that of the melted metal, it is completely or partially destroyed because it is exposed for too long a time to the high temperature. Usually the foam of the form burns the faster the greater is its surface momentarily in contact with the melted metal. This means that the cross-sections of the foam form with greater diameters allow the melted metal to pass more rapidly than those with smaller diameters. As a result, at the recess walls with greater diameters the metal starts solidifying prior to the filling of the sections with a smaller diameter. The part of the form with a small diameter is not filled with the metal and so the casting itself is not complete and cannot be used.

The task of the invention is a process for the production of objects with complicated shapes, mainly for the purposes of the industrial arts, e.g., from aluminum, zinc, non-ferrous metals, etc. by means of casting. By applying this process, the casting form can be made rapidly and inexpensively in a proper form, it can be embedded easily into the sand and the form recess that is this recess can be prepared with the required shape. During casting the wall is not injured, the design and ornamental elements fixed onto the surface of the object to be cast remain in a fixed place and position, they are not destroyed during casting furthermore, the melted metal fills every part of the form recess, and so a complete casting with a correct shape can be achieved.

The invention solves this task by suggesting a process by which a practically completely combustible foam is applied as the material of the latter, the casting form is embedded into the sand, left there and the melted metal is poured onto it. The process is characterized in that foam layer is removed from the places of the foam casting form where the melted, streaming metal could injure the walls, and/or where objects, profiles or ornamental elements are to be fixed prior to the casting, and/or where it is intended to decrease the transmission rate of the melted metal.

The removed layer is substituted by at least one protective layer consisting of a material with a stronger structure, lower thermal conductivity, lower burning and gasifying rates than those of the foam form material. Subsequently the separated surfaces are reconnected by gluing and after embedding this casting form into the sand, the metal is poured onto the foam and the burning or gasifying of the foam is retarded and regulated at the required places with the help of the protective layers.

In addition to the above, the process according to the invention is characterized by optionally using as the material of the protective layer(s) mineral materials, e.g. plaster, clay, concrete or metal oxides that are brought into a dispersed state with an aqueous solution of polyvinyl acetate or polyvinyl propionate. The protective layer made of this material is brought onto the separated surface of the foam, and afterwards the separated foam layer is applied again onto the foam casting form, it is set back into its original position and is glued on.

Furthermore, the process according to the invention can be characterized by applying a metal foil as a protective layer between the removed foam layer and the foam casting form.

Furthermore, the process according to the invention also suggests retarding the burning or gasifying of the casting foam of the casting form by selecting the quality and/or the thickness of the material of the protective layer, and regulating the retardation in this way.

Furthermore, the process according to the invention may be characterized in that the transmit cross section is temporarily closed, partially or completely, in the stream of the melted metal and so the direction of the metal stream is temporarily regulated.

The process according to the invention also suggests that, at the place of an ornamental element or profile, made of a material different of that of the casting, that is to be fixed onto the surface of the casting, a recess is made in the foam of the casting form, a protective layer is created behind the recess, that reaches to the head plate of the recess, the profile or the ornamental element is glued into the recess, and the form is embedded into the forms and together with the profile or the element.

Figure 2:
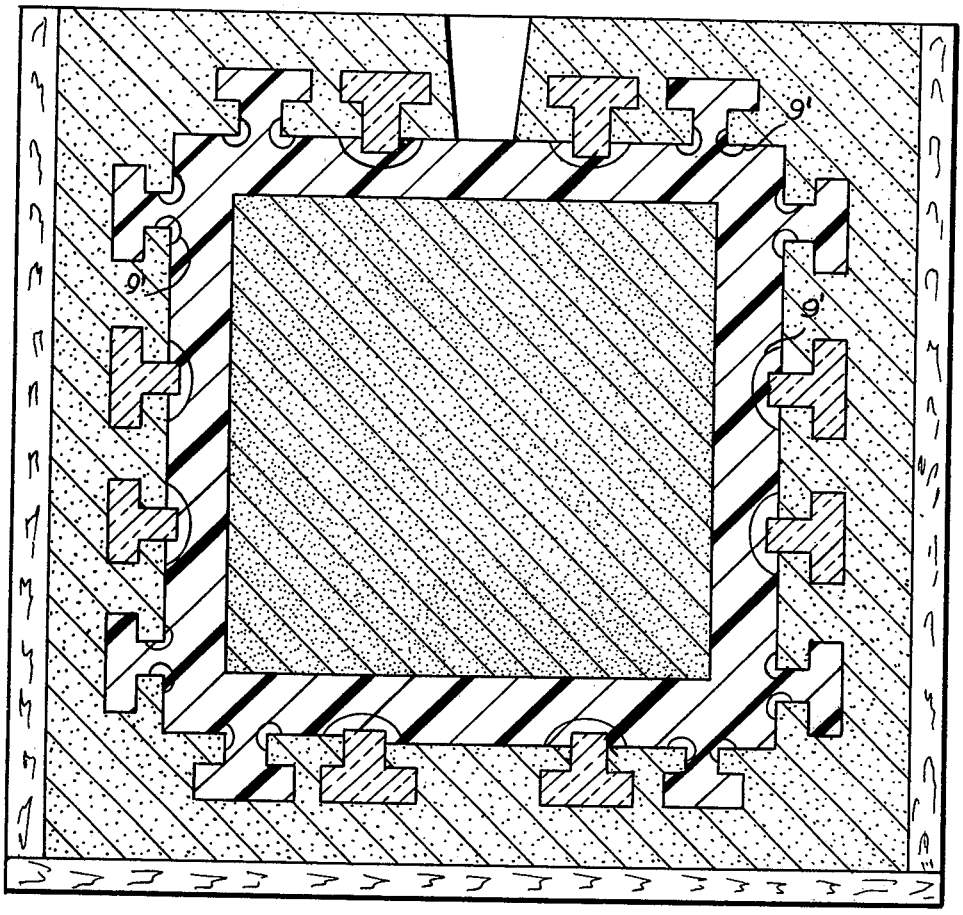

Details of the process according to the invention are shown in the accompanying drawing in relation to exemplary objects being cast, and wherein FIG. 1: shows a casting form made of a foam suitable for the faultless casting of an aluminum or bronze object (a human body); the casting form is already in the flask embedded in the sand; and FIG. 2: illustrates a foam casting form for a picture or mirror frame, e.g. of aluminium or zinc.

The form of FIG. 1 shows a stylized human body that is created by using traditional methods, e.g. from rods having circular cross-sections and from sheets and bands. These parts of the objects are joined upon bending the rods, cutting out the sheets, and eventually welding them. In this way a complete shape is realized. This is a rather time-consuming process and it is not possible to achieve two identical pieces in a series. An artistic effect can however be ensured only when every piece of a contemplated series is identical with that designed by the artist.

A further disadvantage is that the preparation of the object—in the abovementioned case the shape of a human body—requires relatively expensive semi-finished products as initial materials. All these disadvantages are the results of the fact that such objects cannot be made with well known casting methods, because all the cross-sections are small.

By applying the process according to the invention the object shown in FIG. 1 can be prepared in an easy and exact manner. The first specimen of the object is pressed into plaster, and after solidifying it is removed from it. The negative shape of one part of the object remains in the plaster. Further plastic beds are made for other parts of the object and one prepares in them the negatives of these other parts when all negative parts are ready, the plaster beds are set together—after proper additional forming or trimming—so that a composite recess of the object is achieved after this adjustment.

Into this recess—in a well known way—polystyrene, polyethylene or similar material is poured and foamed up. The foam will constitute hereafter a casting form. This foam is practically completely combustible or it can be completely gasified. With the help of the complete plaster bed, as many foam forms can be produced, as are required for the contemplated series.

When the foam form is ready one has to check for places of the object to be casted where a danger of some damage might exist. In FIG. 1 these are marked with numerals 1, 2, 3, 4, 5, 6 and 7. At these places there are sharp angles and branches. It is here that the streaming melted metal could ruin the corners of the sand face after the burning of the foam. These places have therefore to be protected and supported during the intensive and relatively fast streaming of the melted metal.

With this in mind, one separates at these places one layer of the foam from the form—e.g. with a glowing resistance strip or wire connected to a power source. Onto the internal surface of the removed layer a layer is brought up with a brush, by spraying or any other method which layer consists of a material that is more solid, has lower thermal conductivity, does not burn or gasify, or at least at a lower rate, than the foam itself. The applied layer is properly dried and the foam layer separated from the form is glued back to the foam form, with the new protective layer being inside.

For the protective layer, a burnable or gasifiable material with minimum residue is being used. Examples are mineral materials, such as plaster, clay, concrete or metal oxides, metal powder or metal foils. Grain-shaped materials, are brought into a dispersed state with aqueous solutions of polyvinyl acetate, polyvinyl propionate, and the obtained material is air dried with a relatively high humidity content, upon having applied the material to the foam layer, below the softening temperature of the foam.

Protective layers, 1', 2', 3', 4', 5', 6' inhibit during the casting the complete burning of the foam layer between them and the sand face—that has been removed when making the casting form from the complete plaster form—at the beginning of the casting process. These layers protect the foam layer of the form against combustion and/or gasification until the major part of the casting recess burns out, that is till the main part of the casting form is filled with the melted metal. Then the protective layers break through or melt, and thereafter the protected foam layer also burns and the melted metal fills up this recess as well.

In the place marked with 7 of FIG. 1, the pouring down melted metal causes a strong erosive effect on the wall of the form recess. This place can be protected against the strong mechanical stress so that a metal foil layer 7' is applied beside or around the place 7. The material of the metal foil is preferably identical with that of the coating. The protected foam layer at 7 burns only after the melting of the metal foil of 7', when the place 7 of the form recess, below the above place is completely filled with the melted metal.

There are objects, where, in the course of the melted metal pouring downwards, there are sections with substantially smaller cross-sections above a recess having a large cross-section. These usually branch out from the recess having the large cross-section. This is the case if the human body shown in FIG. 1 had trunk diameter tenfold of that shown in the drawing.

In these cases it can frequently be observed that by the time the trunk and the sections under it are filled with the melted metal, the latter already starts to solidify before also filling the arm or limb parts. When applying the process according to the invention the protection layer 8' is put into a further trunk, that temporarily, partially or completely closes the cross-section of the trunk during the casting. Thus the metal pouring from downwards flows through the head and neck parts into only a portion of the trunk, and from there, temporarily hindered, it flows into the arms. When the arm parts are also filled, the protective layer 8' breaks through or melts on the effect of the hydrostatic pressure and/or the heat, and the metal pours down free through the whole cross-section of the trunk toward the feet, and after filling them, also fills the trunk, the neck and the head of the human body being cast.

The delay of the protective layer burning through can be regulated by selecting the quality and the thickness of this material.

In FIG. 2 a picture frame or mirror frame with complicated form is cast according to the process of the invention. T-shaped profiles protrude from the frame. Part of the profiles is made from the material of the casting, others are made from some other material, fashioned prior to the casting. The profiles made prior to the casting differ not only in their material, but also in the color, and external appearance from the T-shaped profiles made from the casting material.

In this case, the parts of the foam casting form where the T-shaped profiles made in advance will be located are provided with appropriate recesses, and the T-profiles are glued into these recesses. At the places of the foam casting form where the sand face could become damaged during the casting protective layers are applied as was explained for in FIG. 1. In FIG. 2, such protective layers are shown at 9'. In a similar way other ornamental elements, e.g. glass-like profiles, stones and others can be fitted into the foam casting form. If the surface of the casting or a part of it is to be coated with pulverized stone, the latter is applied by gluing onto the surface of the casting form and is embedded in the already mentioned manner. When the surface is to be coated with pulverized stone, a protective layer is placed behind the separated foam layer onto the section to be coated.

The main advantages of the process according to the invention are the following. The casting form can be speedily and inexpensively realized. The casting forms are completely identical in shape and dimension even in the case of small series. The casting form can be embedded into the sand in a simple way, and the casting recess can be precisely formed. During the casting the wall of the casting recess cannot be injured. Ornamental elements and profiles of different materials fixed to the surface of the object to be cast are in the finished casting exactly in the prescribed place and position and they are not damaged during the casting. The melted metal fills every part of the form, so that a complete and precise casting is achieved.

I claim:

1. A method for casting objects having complicated shapes from aluminum, zinc, and non-ferrous metals, for use in the industrial arts, comprising the steps of: using a completely combustible and gasified foam material to constitute a form in which the objects are cast; removing a thin surface layer of the foam from those surface areas where a wall thereof could be damaged by flowing melted metal, where ornamental elements or profiles are to be included in the objects prior to casting, or where the rate of flow of melted metal is to be decreased; substituting the removed foam layer by a protective layer of a material with a stonger structure, lower thermal conductivity, lower burning and gasifying rates than those of the material of the foam casting form; reconnecting the separated foam and protective layers by gluing; embedding the casting form into sand; pouring melted metal into a recess defined by the foam form while in the sand; and delaying and regulating the burning of the foam during the pouring of the metal as well as the gasification of the foam.

2. The casting method as defined in claim 1, wherein the material of the protective layer is selected from among mineral materials including plaster, clay, concrete dispersed with aqueous solutions of polyvinyl acetate or polyvinyl propionate.

3. The casting method as defined in claim 1, wherein the step of substituting comprises the step of applying a protective metal-foil layer between the removed foam surface layer and the rest of the foam casting form.

4. The casting method as defined in claim 1, wherein the step of regulating the burning of the foam and its gasification is accomplished by the selection of the material of the protective layer.

5. The casting method as defined in claim 1, further comprising the step of closing temporarily and at least partially at least one flow cross-section provided for the pouring of the melted metal, and thereby regulating at least temporarily the flow direction of the melted metal.

6. The casting method as defined in claim 1, further comprising the step of providing at least one recess in the foam casting form at a place where the ornamental elements or profiles are to be included in the objects from a different material, applying behind this recess a further protective layer that reaches to the sand face of the foam form, and gluing the ornamental elements or profiles into the at least one recess, followed by the embedding step, including the ornamental elements or profiles.

7. The casting method as defined in claim 1, wherein the material of the protective layer is selected from among metal oxides dispersed with aqueous solutions of polyvinyl acetate or polyvinyl propionate.

8. The casting method as defined in claim 1, wherein the step of regulating the burning of the foam and its gasification is accomplished by the selection of the thickness of the protective layer.

* * * * *